US006244692B1

(12) United States Patent
Hiraguchi et al.

(10) Patent No.: US 6,244,692 B1
(45) Date of Patent: Jun. 12, 2001

(54) TANDEM TYPE OF DIRECT PRINTING APPARATUS AND METHOD FOR MAKING A REGISTRATION OF COMPOSITE IMAGE THEREIN

(75) Inventors: Hiroshi Hiraguchi, Toyokawa; Koji Uno, Kobe; Hirokatsu Shimada, Machida; Yoshifumi Shibata, Toyokawa; Toshio Yamaki, Takatsuki, all of (JP)

(73) Assignees: Minolta Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/212,222

(22) Filed: Dec. 16, 1998

(30) Foreign Application Priority Data

Dec. 22, 1997 (JP) ..... 9-352802

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 116, 117, 115, 73, 199; 399/271, 290, 293, 294, 295, 184

(56) References Cited

U.S. PATENT DOCUMENTS 5,477,250 12/1995 Larson ..... 347/55

FOREIGN PATENT DOCUMENTS 0 710 895 A1 5/1996 (EP) .
WO 97/35725 10/1997 (WO) .

*Primary Examiner*—John Barlow
*Assistant Examiner*—Raquel Yvette Gordon
(74) *Attorney, Agent, or Firm*—Morrison & Foerster LLP

(57) ABSTRACT

The tandem type direct printing apparatus 2 comprises a plurality of printing stations 16*a,* 16*b,* 16*c* and 16*d* for propelling printing particles 38 born on a bearing member 30 through a plurality of apertures 56 formed on a printing head 50 and for depositing the printing particles 38 on a print medium 8 to form an image. The plurality of printing stations 16*a,* 16*b,* 16*c* and 16*d* are positioned in the moving direction of the print medium 8 to form the composite image on the print medium 8. The method of the present invention comprises providing a control electrode for deflecting printing particles 70 in adjacent to each aperture 56 in at least one of the plurality of printing stations 16*a,* 16*b,* 16*c* and 16*d*, the control electrode 70 being positioned at least one side of a direction different from the moving direction of the print medium 38; and applying a voltage to the control electrode 70 so that the printing particles 38 passing through the aperture 56 are deflected to adjust the position of the image formed on the print medium in the perpendicular direction to the moving direction of the print medium 8.

5 Claims, 7 Drawing Sheets

TANDEM TYPE OF DIRECT PRINTING APPARATUS AND METHOD FOR MAKING A REGISTRATION OF COMPOSITE IMAGE THEREIN

This application is based on application No. H9-352802 filed in Japan on Dec. 22, 1997, the content of which is hereby incorporated by reference.

FIELD OF THE INVENTION

The present invention relates to a tandem type of direct printing apparatus for use in a color copying machine and printer and to a method for making a registration of a composite image in the tandem type of direct printing apparatus.

BACKGROUND OF THE INVENTION

U.S. Pat. No. 5,477,250 issued on Dec. 19, 1995 discloses a tandem type of direct printing apparatus. In the direct printing apparatus, four printing stations are disposed along a sheet moving direction. Each printing station comprises a toner carrier (or developing sleeve roller) retaining toner on its outer periphery, a backing electrode opposed to the toner carrier and a printing head disposed between the toner carrier and the backing electrode, the printing head having a plurality of apertures and a plurality of electrodes surrounding each aperture. On the outer periphery of the toner carrier in each printing station are retained toner having different colors, for example, magenta, cyan, yellow and black. The backing electrode of each printing station is electrically connected to a power source, thereby between the toner carrier and the backing electrode is formed an electric field for attracting the toner on the toner carrier and propelling it toward the backing electrode through the apertures of the printing head. Between the printing head and the backing electrode in each printing station is formed a passage for a sheet.

When an ON voltage is applied to the electrode of the printing head in the printing station positioned at the most upstream side in the sheet moving direction, for example, the magenta printing station, the toner attracting force due to the electric field between the toner carrier and the backing electrode propels the toner on the toner carrier through the apertures toward the backing electrode and adheres it to the sheet. When an OFF voltage is applied to the electrode of the printing head, the toner attracting force does not affect the toner on the toner carrier, whereby the toner is never propelled. Thus, when ON and OFF voltage applied to the electrode of the printing head are controlled on the basis of a desired image signal, a magenta image corresponding to the image signal is printed on the sheet. In the same manner, by controlling the ON and OFF voltage applied to the electrode of the printing head in each of the downstream printing stations a different color of image is laid on the previously printed image to form a desired image.

In the aforementioned tandem type of direct printing apparatus, as the images formed by the printing stations are overlaid on each other, it is necessary that each aperture of printing head of one printing station corresponds to that of the other printing stations and that the corresponding apertures between the printing stations are aligned on a line parallel to the sheet moving direction. However, each printing station is installed separately from each other. Therefore, the corresponding apertures between the printing stations are shifted in a direction perpendicular to the sheet moving direction (hereinafter referred as a main scanning direction) due to the installation error of the printing head of each printing station. As the position shift of the apertures in the main scanning direction results in color deviation of the image, it is not possible to obtain a clear image.

For example, as shown in FIG. 9, in the case that an installation error of 50 $\mu$m exists between the first printing station 104*a* and the second printing station 104*b* which have six apertures 102 with a pitch of 42 $\mu$m, a position shift or a color deviation of 50 $\mu$m which is same as the installation error is caused between the first aperture 102 of the first printing station 104*a* and the first aperture 102 of the second printing station 104*b*. In order to eliminate such color deviation, after setting the printing head 106 of the second printing station 104*b*, the position of the printing head 106 can be adjusted with high precision so that the installation error become zero. However, as this adjusting work is very difficult, the accuracy obtained by the adjusting work is limited. Even though each printing station has been installed with high accuracy, a position shift will be caused due to environmental temperature or aging, resulting in color deviation.

SUMMARY OF THE INVENTION

Accordingly, the present invention has been accomplished to solve the aforementioned disadvantages of the prior arts. An object of the present invention is to provide a tandem type of direct printing apparatus and a method for making a registration of a composite image in the tandem type of direct printing apparatus in which even though position of each printing station is shift, color deviation is not caused, obtaining a high definition image.

In order to achieve the aforementioned object, according to the present invention, there is provided a method for making a registration of a composite image in a tandem type direct printing apparatus, the tandem type direct printing apparatus comprising a plurality of printing stations for propelling printing particles born on a bearing member through a plurality of apertures formed on a printing head and for depositing the printing particles on a print medium to form an image, the print medium relatively moving in a direction, the plurality of printing stations being positioned in the moving direction of the print medium to form the composite image on the print medium, the method comprising:

providing a control electrode for deflecting printing particles in adjacent to each aperture of the printing head in at least one of the plurality of printing stations, the control electrode for deflecting printing particles being positioned at least one side of a direction different from the moving direction of the print medium; and applying a voltage to the control electrode for deflecting printing particles so that the printing particles passing through the aperture of the printing head are deflected to adjust the position of the image formed on the print medium in the perpendicular direction to the moving direction of the print medium.

In the method for making a registration of a composite image in a tandem type direct printing apparatus of the present invention as described above, even though a position shift is caused after installing the printing stations, the printing particles passing through the apertures of the printing head are deflected by applying a voltage to the control electrode for deflecting printing particles, whereby color deviation is corrected.

In order to achieve the aforementioned object, according to the present invention, there is also provided a tandem type direct printing apparatus comprising a plurality of printing stations for depositing printing particles on a print medium relatively moving in a direction to form an image, the plurality of printing stations being positioned in a moving direction of the print medium to form the composite image on the print medium, each printing station comprising:

a bearing member for bearing charged printing particles thereon;

a backing electrode opposed to the bearing member;

a power supply connected to the backing electrode for generating an electric field that attract the charged printing particles on the bearing member to propel the same toward said backing electrode;

a printing head disposed between the bearing member and the backing electrode, the printing head having a plurality of apertures through which the printing particles can propel and a plurality of control electrodes for propelling printing particles disposed around the plurality of apertures;

a driver for applying the plurality of control electrodes for propelling printing particles with a voltage for allowing the printing particles to be propelled and a voltage for forbidding the printing particles to be propelled in response to an image signal; and a controller for outputting the image signal to the driver;

at least any one of printing stations further comprising:

a control electrode for deflecting printing particles in adjacent to each aperture of the printing head, the control electrode for deflecting printing particles being positioned at least one side of a direction different from the moving direction of the print medium; and a control means for deflecting printing particles, the control means applying a voltage to the control electrode for deflecting printing particles so that the printing particles passing through the aperture of the printing head are deflected to adjust the position of the image formed on the print medium in the perpendicular direction to the moving direction of the print medium.

Preferably, the control means for deflecting printing particles may comprise a circuit for setting deviation of registration in the perpendicular direction to the moving direction of the print medium between the image formed in the printing station which is provided with the control means for deflecting printing particles and the image formed in any one of another printing stations, and a driver for applying a voltage to the pair of the control electrodes for deflecting printing particles in accordance with the deviation set by the circuit for setting deviation of registration. The control electrodes for deflecting printing particles may preferably skewed with respect to the moving direction of the print medium. The bearing member in each of the printing stations may bear the charged printing particles with different color thereon to perform color print.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
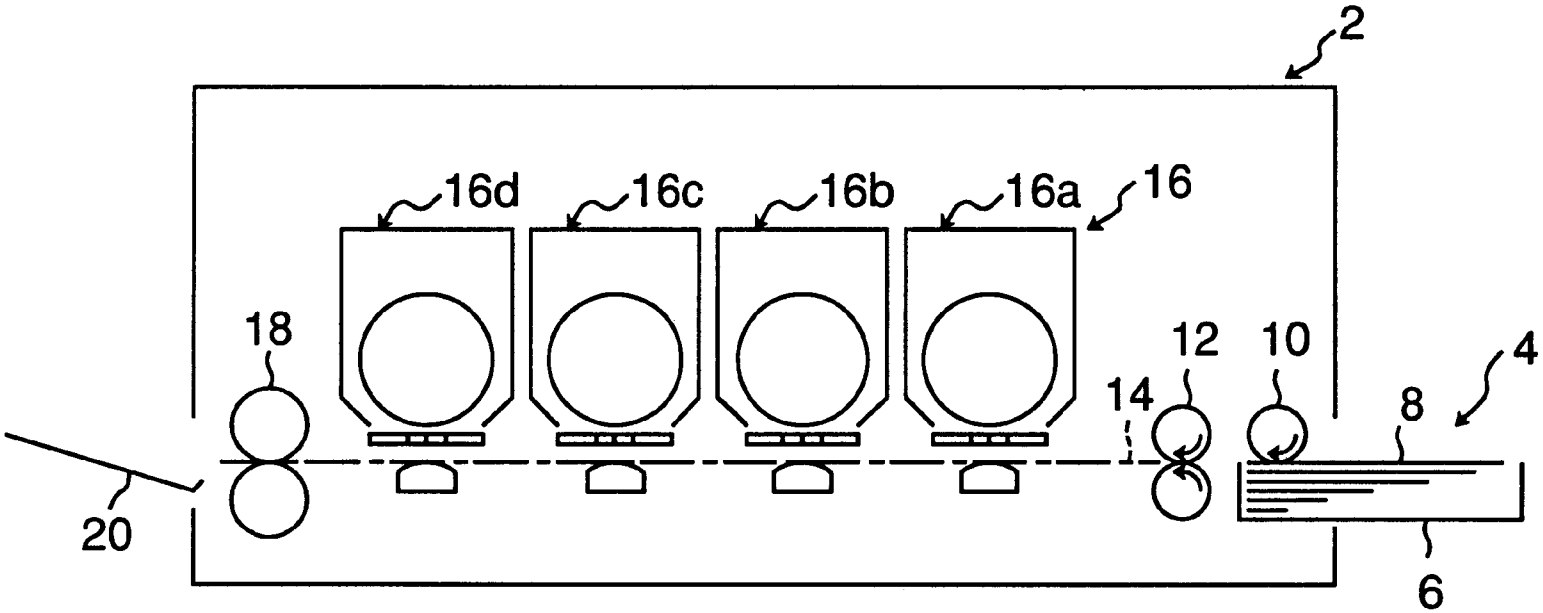
FIG. 1 is a schematic cross-sectional side elevational view of a first embodiment of a tandem type direct printing apparatus of the present invention.

With reference to the drawings and, in particular, to FIG. 1, there is shown a tandem type of direct printing device, generally indicated by reference numeral 2, according to the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed. The sheet 8 is conveyed along the sheet passage 14 by an unshown transfer belt.

The printing station 16 comprises four printing stations 16*a*, 16*b*, 16*c* and 16*d* equally spaced along the sheet passage 14. These printing stations 16*a*, 16*b*, 16*c* and 16*d* have essentially same construction respectively and therefore one printing station, for example, the printing station 16*a* positioned at the most upstream side in the sheet passage 14 will be explained hereinafter.

Figure 2:
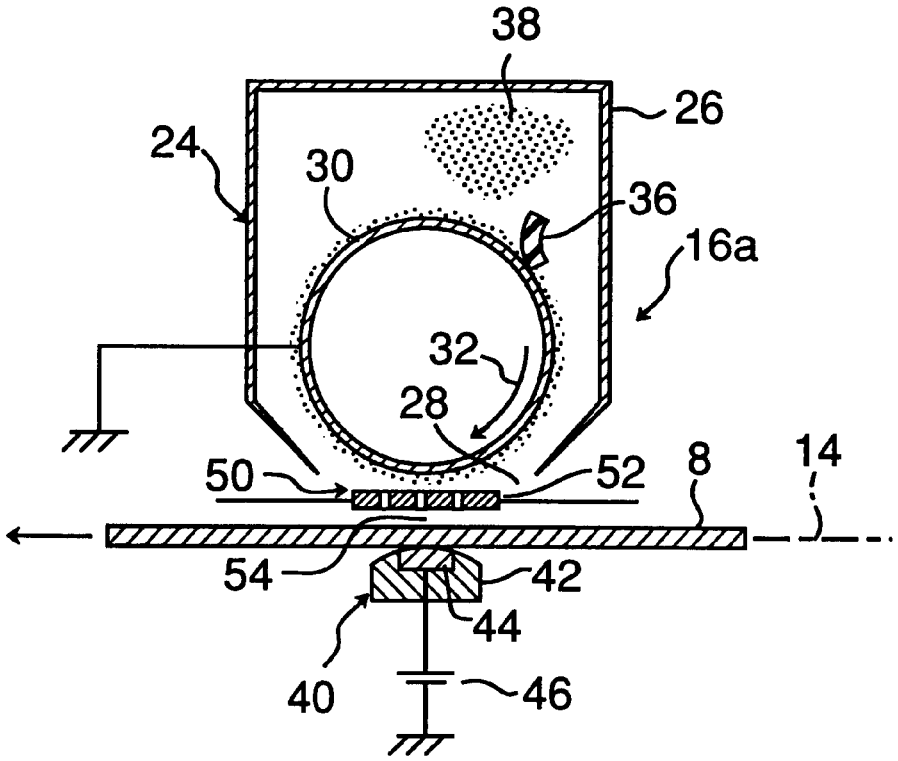
FIG. 2 is a cross-sectional side elevational view of a printing station.

Referring to FIG. 2, the printing station 16*a* comprises a developing device generally indicated by reference numeral 24 above the sheet passage 14. The developing device 24 comprises a container 26 which has an opening 28 confronting the sheet passage 14. Adjacent the opening 28, a developing roller 30 as a bearing member of printing particles according to the present invention is supported for rotation in a direction indicated by an arrow 32. The developing roller 30 is made of conductive material and is electrically connected to the earth. A blade 36, preferably made from a plate of elastic material such as rubber or stainless steel, is disposed in contact with the developing roller 30.

The container 26 accommodates printing particles, i.e., toner particles 38. In this embodiment, the toner particles capable of being charged with negative polarity by the contact with the blade 36 are used. The color of the toner particles 38 at each of the printing stations 16*a*, 16*b*, 16*c* and 16*d* is different from each other. For example, the color of the toner particles 38 is magenta at the printing station 16*a*, cyan at the printing station 16*b*, yellow at the printing station 16*c* and black at printing station 16*d*, thereby color printing is possible.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) so that the backing electrode 44 is provided with, for example, a voltage of ±1200 volts. Thus, between the backing electrode 44 and the developing roller 30 are formed an electric field E that the negatively charged toner particles 38 on the developing roller 30 are electrically attracted to the backing electrode 44. The backing electrode 44 comes into contact with the back side surface of the sheet 8 to be conveyed via a transfer belt not shown.

Figure 3:
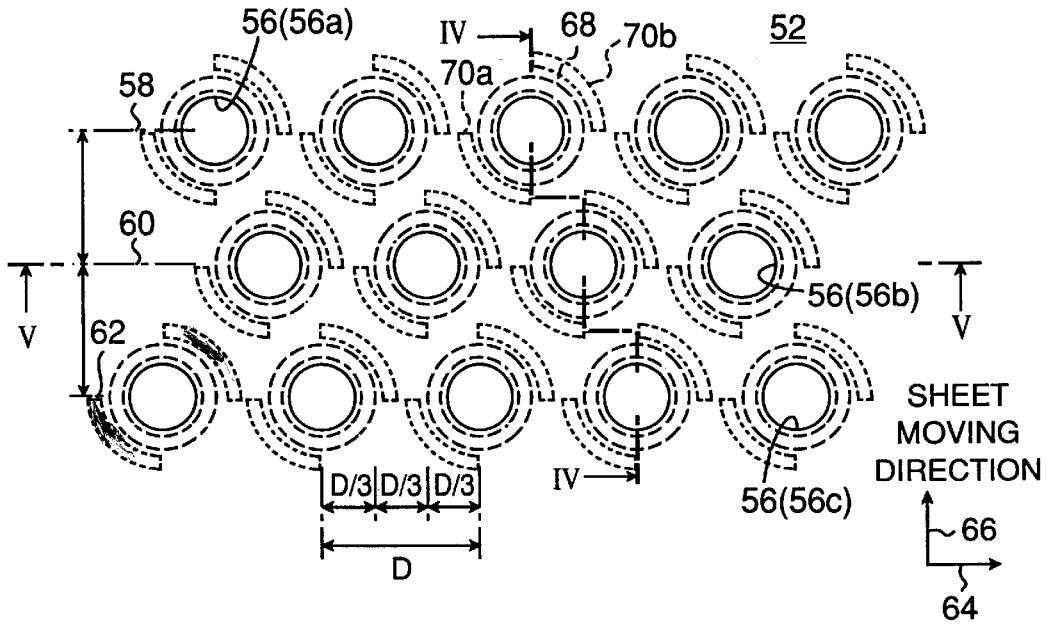
FIG. 3 is an enlarged fragmentary plane view of a printing head.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 50 to 150 micrometers. As shown in FIGS. 2 and 3, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance D/N to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first electrode 68 as a control electrode for propelling printing particles and a pair of arcuate second electrodes 70*a*, 70*b* as a control electrode for deflecting printing particles, each of which surrounds the aperture 56. The first electrodes 68 are disposed on one side opposing the developing roller 30, while the pair of second electrodes 70*a*, 70*b* are disposed on the other side opposing the backing electrode 44. In order to prevent the second electrode 70*a*, 70*b* of the apertures 56 adjacent to each other in a direction perpendicular to the sheet moving direction 66 from coming into contact with each other, the pair of second electrodes 70*a*, 70*b* are arranged to oppose each other in an oblique direction with an angle of 45 degrees with respect to the sheet moving direction. If there is no possibility that the second electrodes 70*a*, 70*b* of the apertures 56 adjacent to each other come into contact with each other, each pair of second electrodes 70*a*, 70*b* are arranged to oppose each other in a direction perpendicular to the sheet moving direction 66.

Figure 7:
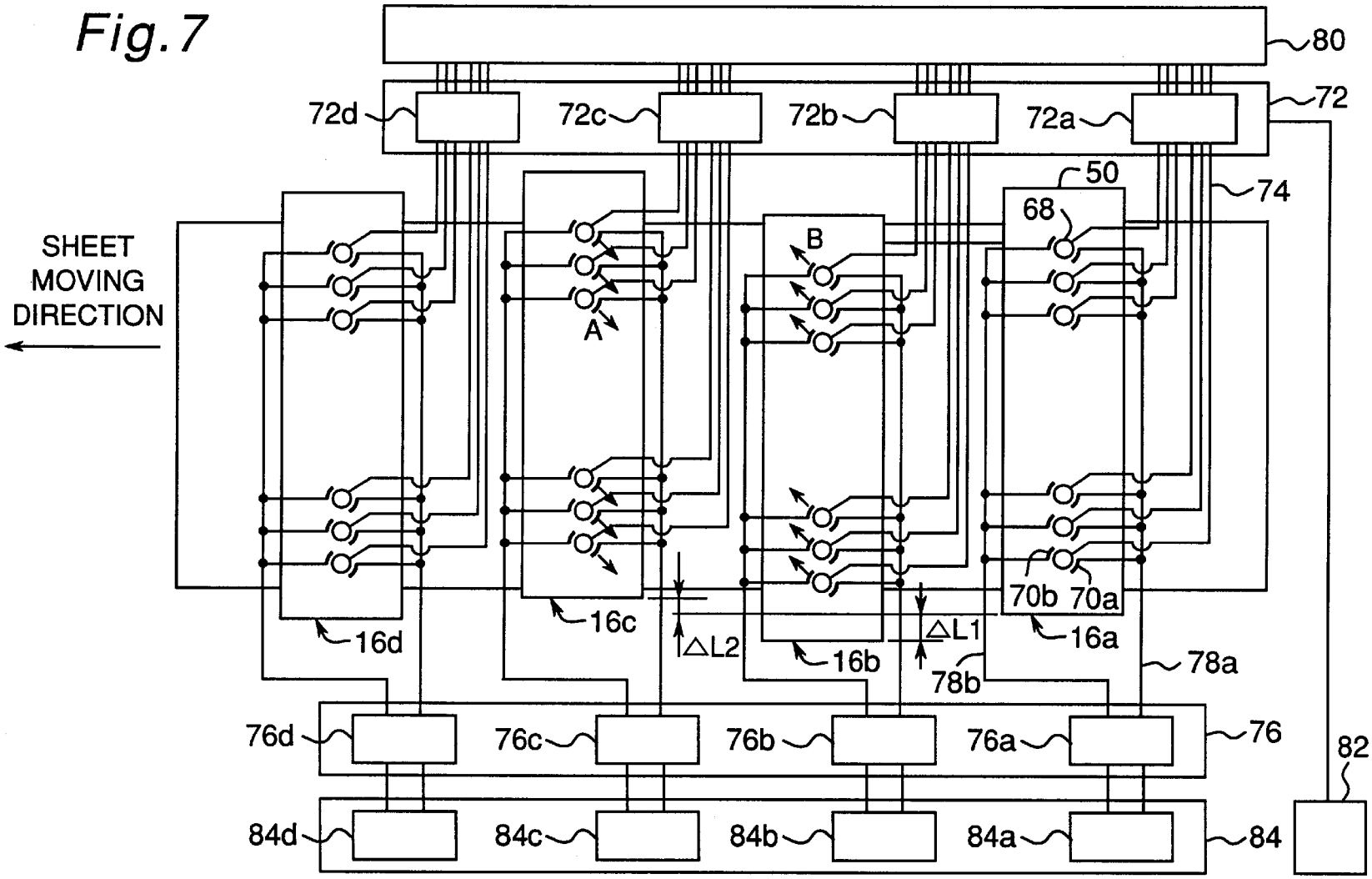
FIG. 7 shows a plane view of the printing head showing a wiring condition of the first control electrodes for propelling printing particles and the second control electrodes for deflecting printing particles in each printing station.

FIG. 7 shows a detailed wiring condition of the first electrodes 68 and the second electrodes 70*a*, 70*b*. The first electrodes 68 are electrically communicated with a first driver 72 through printed wires 74, whereby from the first driver 72 is transmitted an image signal. The first driver 72 is in turn electrically communicated with a controller 80 that feeds out data of image to be reproduced by the printing device 2 and also communicated with a circuit 82 for generating pattern for detecting registration as described hereinafter. The image signals to be transmitted to the first electrodes 68 consist of a DC component constantly applied to the first and second electrodes 68, 70 and a pulse component applied to the first electrodes 68 in response to the image data from the controller 80 for forming dots on the sheet 8. In the concrete, in this embodiment, for the first electrode 68, the base voltage V1(B) is about −50 volts, and the pulse voltage V1(P) is about +300 volts.

On the other hand, the pairs of second electrode 70*a*, 70*b* are electrically communicated with a second driver 76 through printed wires 78*a*, 78*b*, whereby from the second driver 76 is transmitted a toner deflecting control voltage. In order to determine the toner deflecting control voltage, a circuit 82 for generating pattern for detecting registration and a circuit 84 for setting deviation of registration. The circuit 82 for generating pattern for detecting registration is to transmit image signal of registration detecting pattern, which comprises a plurality of lines extending parallel to the sheet moving direction, to the first electrode 68 of the printing stations 16*a*, 16*b*, 16*c* and 16*d* through the driver 72 and allow the printing stations 16*a*, 16*b*, 16*c* and 16*d* to print the registration detecting pattern. The circuit 84 for setting deviation of registration is to set a voltage value corresponding to a deviation of registration at each printing station in a direction perpendicular to the sheet moving direction, which is detected from the printed registration detecting pattern, and output the deviation of registration at each of the printing stations 16*a*, 16*b*, 16*c* and 16*d* to each of the drivers 76*a*, 76*b*, 76 c and 76*d*. As the circuit 84 for setting deviation of registration, a variable resistor or a digital data input device can be used.

Figure 5:
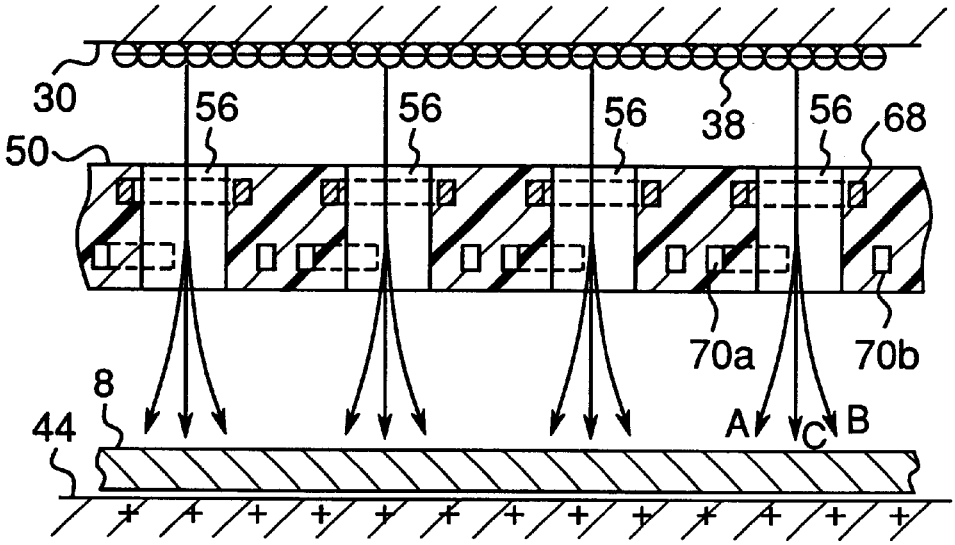
FIG. 5 an enlarged fragmentary cross-sectional view of the printing head, developing roller and backing electrode taken along a line V—V in FIG. 3.
Figure 6:
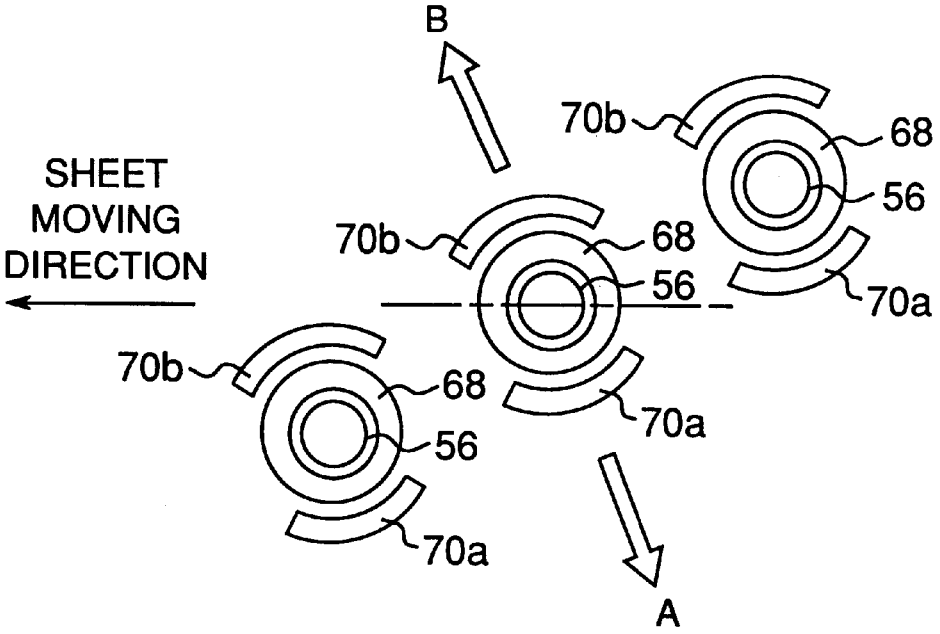
FIG. 6 is a plane view showing electrodes around the apertures of the printing head.

The method for setting the deviation of registration by the circuit 84 for setting deviation of registration will be explained more concretely hereinafter. In the case that one printing station is shifted to the left side with respect to the sheet moving direction, i.e. to the direction of A as shown in FIG. 6, according to the deviation, a voltage of −50 to −150 bolts is set to the second electrode 70*a*, while a voltage of 0 to +200 bolts is set to the second electrode 70*b*. As a result, as shown in FIG. 5, the toner particles passing through the aperture 56 of the printing head 50 is deflected to the direction of B. On the contrary, in the case that the printing station is shifted to the right side with respect to the sheet moving direction, i.e. to the direction of B as shown in FIG. 6, according to the deviation, a voltage of 0 to +200 bolts is set to the second electrode 70*a*, while a voltage of −50 to −150 bolts is set to the second electrode 70*b*. As a result, as shown in FIG. 5, the toner particles passing through the aperture 56 of the printing head 50 is deflected to the direction of A. Moreover, in the case of no deviation of printing station, same voltage is set to both the second electrode 70*a* and the second electrode 70*b* within the range of 0 to +200 bolts. As a result, as shown in FIG. 5, the toner particles passing through the aperture 56 of the printing head 50 is not deflected.

Having described the construction of the printing device 2, its operation will now be described.

Figure 4:
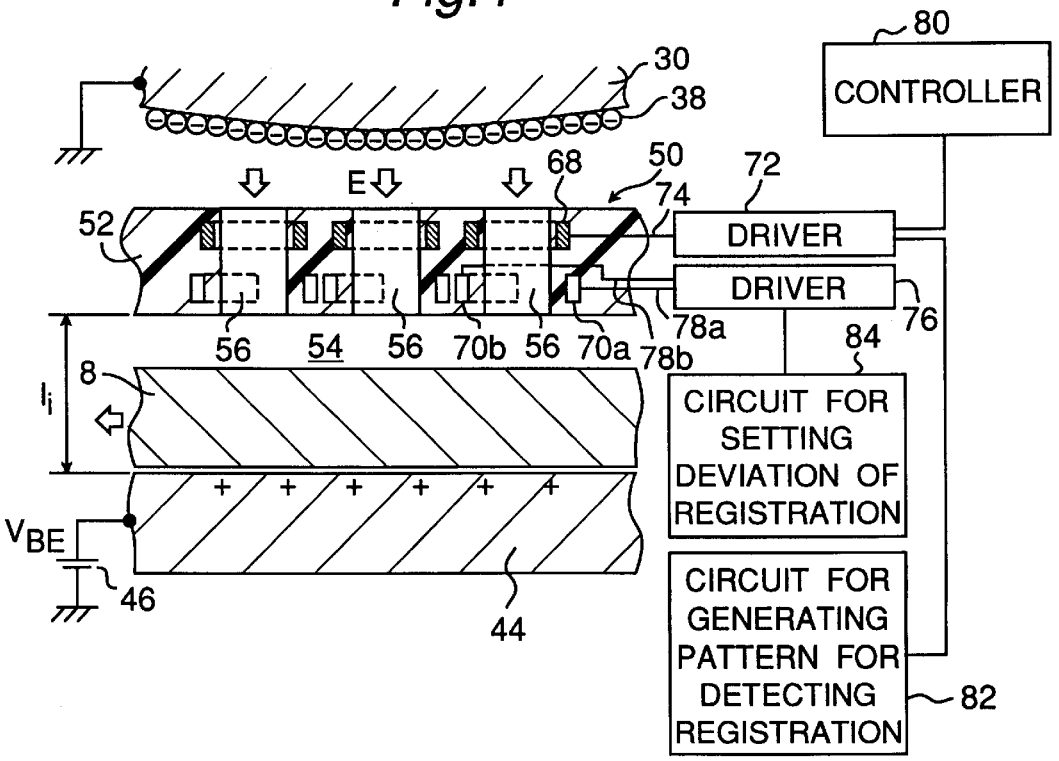
FIG. 4 is an enlarged fragmentary cross-sectional view of the printing head, developing roller and backing electrode taken along a line IV—IV in FIG. 3.

As shown in FIG. 2, in the first printing station 16*a*, the developing roller 30 rotates in the direction indicated by the arrow 32. The toner particles 38 are deposited on the developing roller 30 and then transported by the rotation of the developing roller 30 into a contact region of the blade 36 and the developing roller 30 where the toner particles 38 are provided with triboelectric negative charge by the frictional contact of the blade 36. Thereby, as shown in FIG. 4, incremental peripheral portions of the developing roller 30 which has passed through the contact region bear a thin layer of charged toner particles 38.

In the printing head 50, at the time of no printing, the first electrodes 68 and second electrodes 70*a*, 70*b* are constantly biased to the base voltage V1(B) of about −50 volts and V2(B) of about −100 volts respectively. Therefore, no electric field through the apertures is formed due to voltage applied to the first electrodes 68 and second electrodes 70*a*, 70*b*, whereby the negatively charge toner particle 38 on the developing roller 30 stays on the developing roller 30 without propelling toward the aperture 56.

The controller 80 outputs the image data corresponding to a magenta image to be reproduced to the drivers 72 and 76. In response to the image data, the first driver 72 supplies the pulse voltages V1(P) (about +300 volts) to the first electrode 68, while the second driver 76 supplies the pulse voltage V2(P) (about 0 to +200 volts or about −50 to −150) to the second electrodes 70*a*, 72*b*. As a result, the toner particles 38 on the portions of the developing roller 30 confronting the biased electrodes are electrically attracted by the first electrodes 68 and second electrodes 70*a*, 70*b*. This energizes a number of toner particles 38 to propel by the attraction force of the backing electrode 44 into the opposing aperture 56. With the different voltage value of pulse voltage V2(P) applied to the second electrode 70*a* and 70*b* respectively, the deflection of the toner particles passing through the aperture can be realized as described before.

The toner particles 38 passed through the aperture 56 are then deposited on the sheet 8 which is moving past the printing zone 54, thereby forming a layer of the magenta toner particles on the sheet 8.

In the same manner, in the second printing station 16*b*, a layer of cyan toner particles is formed over the layer of magenta toner particles formed by the first printing station 16*a*. Then, in the third printing station 16*c*, a layer of yellow toner particles is formed over the layer of cyan toner particles formed by the second printing station 16*b*. Finally, in the fourth printing station 16*d*, a layer of black toner particles is formed over the layer of yellow toner particles formed by the third printing station 16*c*. Thus, a desired color image is formed on the sheet 8.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

In this embodiment of the tandem type of direct printing apparatus, it is supposed that with respect to the first printing station 16*a* the second printing station 16*b* has an installation error of ΔL1 to the left side when looking at the sheet moving direction, the third printing station 16*c* has an installation error of ΔL2 to the right side when looking at the sheet moving direction, and the fourth printing station 16*d* has no installation error. In this condition, when printing is performed at each of the printing stations 16*a*, 16*b*, 16*c* and 16*d*, color deviations are caused to left and right sides, which is not preferable. Even though each printing station has been is installed with high accuracy, position shift of each of the printing stations 16*a*, 16*b*, 16*c* and 16*d* will be caused due to environmental temperature or aging, resulting in color deviation.

Figure 8:
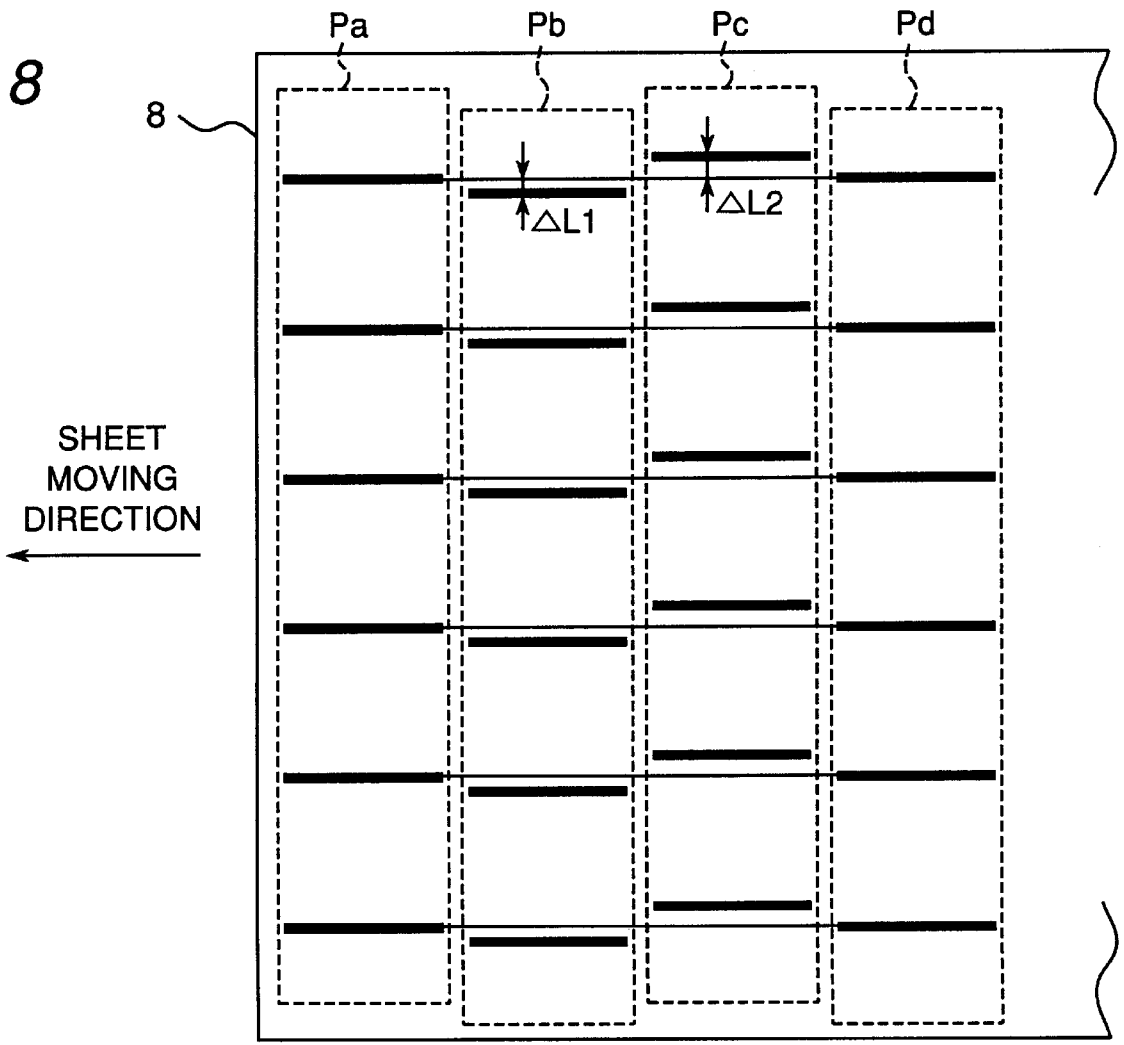
FIG. 8 shows a plane view showing an example of printed pattern detecting registration.
Figure 9:
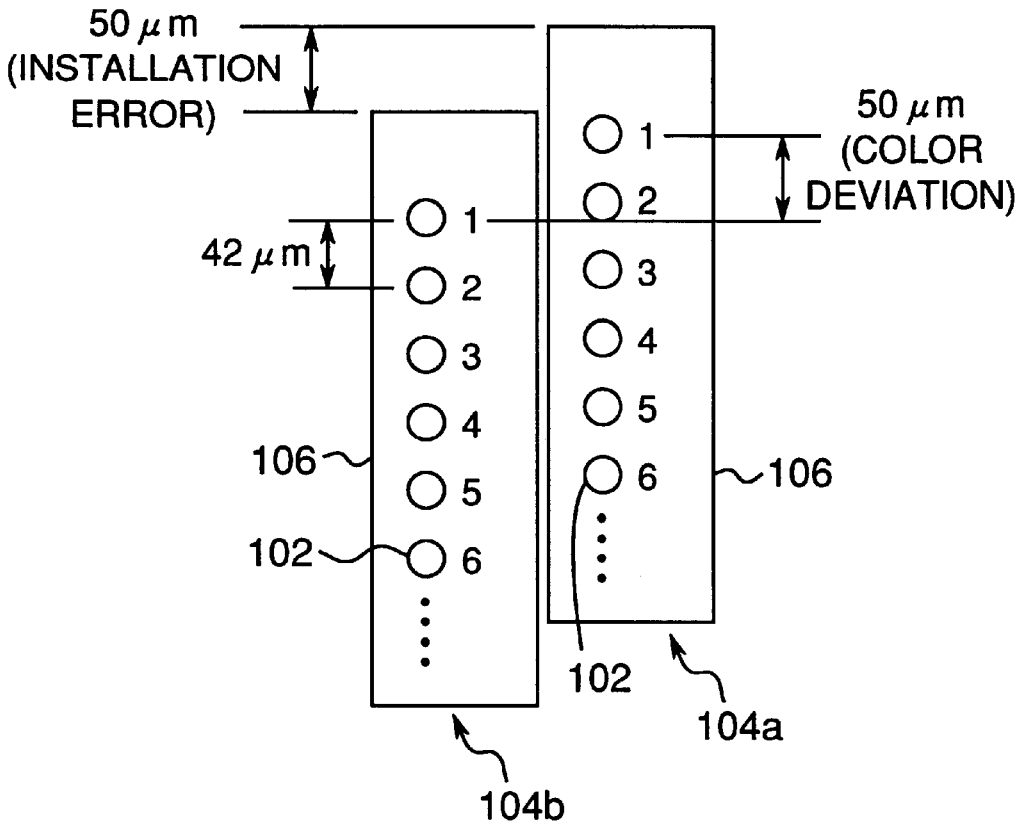
FIG. 9 shows a plane view showing position shift of the apertures of the printing head in each printing stations.

So, in the present embodiment, at the time when the printing stations 16*a*, 16*b*, 16*c* and 16*d* are installed or when the color deviation is caused, the circuit 82 for generating pattern for detecting registration transmits image signal of registration detecting pattern to the first electrode 68 of the printing stations 16*a*, 16*b*, 16*c* and 16*d* through the driver 72 and allows the printing stations 16*a*, 16*b*, 16*c* and 16*d* to print the registration detecting pattern. FIG. 8 shows the printed registration detecting pattern. With respect to the magenta pattern Pa printed by the first printing station 16*a*, the cyan pattern Pb printed by the second printing station 16*b* has a color deviation to the left side with respect to the sheet moving direction, the yellow pattern Pc printed by the third printing station 16*c* has a color deviation to the right side with respect to the sheet moving direction, and the black pattern Pd printed by the fourth printing station 16*d* has no color deviation. The color deviations ΔL1, ΔL2 are detected from the printed registration detecting patterns by means of appropriate method (for example, detection of the printed position by an optical sensor). On the basis of the color deviations ΔL1, ΔL2, the circuit 84 for setting deviation of registration sets a deviation of registration at each of the printing stations 16*a*, 16*b*, 16*c* and 16*d* and outputs a voltage value corresponding to the deviation of registration to each of the drivers 76*a*, 76*b*, 76 c and 76*d*. It should be noted that the voltage values applied to the second electrodes 70*a*, 70*b* at the time of printing the registration detecting pattern are same.

The method for making registration in the condition as shown in FIG. 7 will be more concretely described herein after. In the first printing station 16*a* and the fourth printing station 16*d* which are the basis of making registration, a voltage of +100 bolts is set to the second electrode 70*a*, while a voltage of +100 bolts is also set to the second electrode 70*b*. In the second printing station 16*b* which has a position shift to the left side with respect to the sheet moving direction, a voltage of −150 bolts is set to the second electrode 70*a*, while a voltage of +50 bolts is set to the second electrode 70*b*. In the third printing station 16*c* which has a position shift to the right side with respect to the sheet moving direction, a voltage of +50 bolts is set to the second electrode 70*a*, while a voltage of −150 bolts is set to the second electrode 70*b*.

Thus, in the second printing station 16*b* the toner particles passing through the aperture 56 of the printing head 50 are reflected to the direction of B, while in the third printing station 16*c* the toner particles are reflected to the direction of A. As a result, the color deviation are disappeared in the printing stations 16*a*, 16*b*, 16*c* and 16*d*.

In the aforementioned embodiment, although a pair of (that is to say, two) second electrodes 70*a*, 70*b* are provided with respect to one aperture 56 as a control electrode for deflecting printing particles, the present invention is not limited to this. One control electrode for deflecting printing particles may be provided with respect to one aperture 56. For example, in the aforementioned embodiment, such construction that one electrode 70*b* among two electrode 70, 70*b* is removed is also acceptable. In this case, it is possible to deflect the toner particles to the direction of A, B or C in the same manner as the aforementioned embodiment by properly setting electric potential and polarity of the voltage applied to the second electrode 70*b*. Thus, the color deviation can be corrected even in the construction that the second electrode 70*b* is removed.

Moreover, in the aforementioned embodiment, although the second electrodes 70*a*, 70*b* are independently provided at every apertures 56, the present invention is not limited to this. In the same flexible printed circuit board 52, the second electrodes 70*a*, 70*a*, . . . may be electrically connected to each other, and similarly the second electrodes 70*b*, 70*b*, . . . may be electrically connected to each other.

It is to be understand that any type of developing device capable of being employed in the electrophotographic image forming apparatus can be used instead of the developing device 24 as shown in FIG. 2 of the direct printing apparatuses 2 in the aforementioned embodiments. For example, two component type developing device may be also used other than the one component developing device in the aforementioned embodiment.

Further, the backing electrode 44 is not limited to one described above and may be a roller made of electrically conductive material. The voltage value and its polarity applied to the electrodes are not limited to that described in the aforementioned embodiment and may be determined in accordance with the characteristics of the toner particles.

Furthermore, as a sheet conveying apparatus, an endless belt type of conveying belt or a cylindrical type of conveying drum can be provided. Also, instead of directly printing on a sheet as a printing medium, it is also possible to adhering the printing particles on an intermediate transfer member and then transferring it to a sheet.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method for making a registration of a composite image in a tandem type direct printing apparatus, the tandem type direct printing apparatus comprising a plurality of printing stations for propelling printing particles born on a bearing member through a plurality of apertures formed on a printing head and for depositing the printing particles on a print medium to form an image, the print medium relatively moving in a direction, the plurality of printing stations being positioned in the moving direction of the print medium to form the composite image on the print medium, the method comprising:

providing a control electrode for deflecting printing particles adjacent to each aperture of the printing head in at least one of the plurality of printing stations, the control electrode for deflecting printing particles being positioned to one side of the moving direction of the print medium; and applying a voltage to the control electrode for deflecting printing particles so that the printing particles passing through the aperture of the printing head are deflected to adjust the position of the image formed on the print medium in the perpendicular direction to the moving direction of the print medium.

2. A tandem type direct printing apparatus comprising a plurality of printing stations for depositing printing particles on a print medium relatively moving in a direction to form an image, the plurality of printing stations being positioned in a moving direction of the print medium to form the composite image on the print medium, each printing station comprising:

a bearing member for bearing charged printing particles thereon;

a backing electrode opposed to the bearing member;

a power supply connected to the backing electrode for generating an electric field that attract the charged printing particles on the bearing member to propel the same toward said backing electrode;

a printing head disposed between the bearing member and the backing electrode, the printing head having a plurality of apertures through which the printing particles can propel and a plurality of control electrodes for propelling printing particles disposed around the plurality of apertures;

a driver for applying the plurality of control electrodes for propelling printing particles with a voltage for allowing the printing particles to be propelled and a voltage for forbidding the printing particles to be propelled in response to an image signal; and a controller for outputting the image signal to the driver;

at least any one of printing stations further comprising:

a control electrode for deflecting printing particles adjacent to each aperture of the printing head, the control electrode for deflecting printing particles being positioned to one side of the moving direction of the print medium; and a control means for deflecting printing particles, the control means applying a voltage to the control electrode for deflecting printing particles so that the printing particles passing through the aperture of the printing head are deflected to adjust the position of the image formed on the print medium in the perpendicular direction to the moving direction of the print medium.

3. A tandem type direct printing apparatus as claimed in claim 2, wherein the control means for deflecting printing particles comprises:

a circuit for setting deviation of registration in the perpendicular direction to the moving direction of the print medium between the image formed in the printing station which is provided with the control means for deflecting printing particles and the image formed in any one of another printing stations; and a driver for applying a voltage to a pair of the control electrodes for deflecting printing particles in accordance with the deviation set by the circuit for setting deviation of registration.

4. A tandem type direct printing apparatus as claimed in claim 2, wherein the control electrodes for deflecting printing particles are skewed with respect to the moving direction of the print medium.

5. A tandem type direct printing apparatus as claimed in claim 2, wherein the bearing member in each of the printing stations bears the charged printing particles with different color thereon.

* * * * *